United States Patent [19]

Lesea

[11] 4,415,839

[45] Nov. 15, 1983

[54] ELECTRONIC BALLAST FOR GASEOUS DISCHARGE LAMPS

[76] Inventor: Ronald A. Lesea, 51 Foss Dr., Redwood City, Calif. 94062

[21] Appl. No.: 323,676

[22] Filed: Nov. 23, 1981

[51] Int. Cl.[3] ..... G05F 1/00; H05B 37/02

[52] U.S. Cl. ..... 315/308; 315/209 R; 315/216; 315/247; 315/287

[58] Field of Search ..... 315/308, 287, 247, 209 R, 315/216

[56] References Cited

U.S. PATENT DOCUMENTS

| | | | |
|---|---|---|---|
| 3,541,421 | 11/1970 | Buchman | 315/308 |
| 3,753,071 | 8/1973 | Engel et al. | 363/139 |
| 3,890,537 | 6/1975 | Park | 315/209 R |
| 4,042,856 | 8/1977 | Steigerwald | 315/208 |
| 4,127,795 | 11/1978 | Knoll | 315/209 R |
| 4,170,747 | 10/1979 | Holmes | 315/287 |
| 4,251,752 | 2/1981 | Stolz | 315/208 |
| 4,277,728 | 7/1981 | Stevens | 315/307 |

*Primary Examiner*—Harold A. Dixon
*Attorney, Agent, or Firm*—Thomas E. Schatzel

[57] ABSTRACT

An electronic ballast for energizing one or more gaseous-discharge lamps and for regulating the power consumed thereby, the ballast including a power supply for providing a source of DC power between a pair of outputs, a pair of transistors connected as switches in series between the power-supply outputs, the transistors for selectively coupling to the juncture thereof positive and negative potentials, a voltage-conditioning and current-limiting network for energizing the lamp from the potential developed between the transistor juncture and a power-supply common, and a pulse generator for developing pulses for driving each of the transistors in turn whereby a potential is developed at the transistor juncture which alternates as positive-going and negative-going pulses each separated by a dead time, the pulse generator for monitoring the power consumption level of the lamp and responsive thereto operative to vary the frequency and/or the width of the transistor driving pulses whereby the lamp consumption is regulated. Also included is a third harmonic trap for coupling the power supply to the AC power line to improve the power factor.

32 Claims, 8 Drawing Figures

ELECTRONIC BALLAST FOR GASEOUS DISCHARGE LAMPS

BACKGROUND OF THE INVENTION

1. Field of the Invention

The present invention relates generally to the field of energy conversion for lighting and more specifically to an electronic ballast suitable for use with gaseous-discharge lamps.

2. Description of the Prior Art

Gaseous-discharge lamps, lamps in which light is generated when an electric current, or discharge, is passed through a gaseous medium, are not new to the lighting field. Fluorescent-type gaseous-discharge lamps have been employed for years to provide relatively efficient indoor lighting such as for office buildings. Recently, sodium-vapor-type gaseous-discharge lamps have been employed to replace less efficient lamps in outdoor lighting applications. for example, 250 watt sodium-vapor lamps are commonly used in street lights to replace 400 watt mercury-vapor lamps which are less efficient and which generate less light output. Sodium-vapor lamps in 70, 100, 400, and even 1000 watt sizes are also commonly used.

Unlike incandescent lamps which are self-limiting as a result of their positive-resistance characteristic, a gaseous-discharge lamps have a negative-resistance characteristic. For this reason, gaseous-discharge lamps are operated in conjunction with a ballast which provides the requisite current limiting. Traditionally, ballasts are of core and coil construction. One form is that of a simple choke which provides an inductive impedance for current limiting. Another form is that of a transformer. The transformer form permits voltage conditioning such as providing a high break-down potential which is required for starting instant-start-type fluorescent lamps by ionizing to a plasma the gas therein. For rapid-start-type fluorescent lamps, a pair of windings are included in the transformer for energizing the lamp filaments and, separating the filaments windings, a high-voltage winding having a high reactance for current limiting. Alternatively, a magnetic shunt may be included in the transformer to limit the energy transferred through the magnetic path.

Unfortunately, traditional core-and-coil-type ballasts are relatively inefficient having substantial heat generating losses that are generally equally divided between copper losses in the coil and core losses in the relatively inexpensive grades of iron employed therein. For example, it is not unusual for a traditional core-and-coil-type ballast employed in a dual 40 watt lamp fixture to dissipate from 15 to 20 watts causing the ballast to run quite hot. Further, in many applications, such as in office buildings, this ballast-generated heat must be removed by air conditioning equipment which is itself relatively inefficient. Another problem is that core-and-coil-type ballasts are relatively heavy requiring that associated fixtures be more substantial than would otherwise be necessary.

The regulation afforded by traditional core-and-coil-type ballasts is also relatively poor. Typically, the operating level of fluorescent fixtures employing such ballasts varies as the square of the power-line voltage. Thus, in many applications, excessive lighting, dissipating excessive power, is often employed to insure that minimum lighting levels are achieved.

Compensation, at least in part for variations in line voltage, is often afforded for sodium-vapor-type gaseous-discharge lamps by employing therewith so-called constant-voltage, or ferro-resonant, type transformers having inherent current limiting. Unfortunately, such transformers are relatively expensive, heavy and bulky. Sodium-vapor lamps, moreover, present another regulation problem. Unlike fluorescent lamps across which a voltage drop is developed that remains relatively constant with lamp life, the voltage drop developed across a sodium-vapor lamp often varies as much as two to one during the life of the lamp. As a result, to insure that minimum light levels are achieved, sodium-vapor lamps are often overdriven during most of their lives, at the expense of both power and life, and/or excessive lighting is employed.

Among other problems associated with gaseous-discharge lamps is that they are less efficient when operated at the normal 60 Hz line frequency than when they are operated at higher frequencies. Sodium-vapor lamps often require special starting circuitry. Fluorescent lamps are often difficult to start when cold and, as a result, flicker for some time. Fluorescent lamps require core-and-coil-ballast phasing both to reduce stroboscopic effects and to increase the power factor such lamps present to the line via the ballast.

What may be referred to as an electronic ballast is disclosed in U.S. Pat. No. 4,277,728 which issued to C. Stevens. Included is a switching power supply for developing a source of DC power from AC line power, an inverter for developing a source of high frequency AC power from a portion of the DC power and an RF-type resonant network for coupling a portion of the high frequency AC power to a gaseous-discharge lamp. The resonant network both limits the lamp current and provides a voltage step-up for starting the lamp.

By increasing the frequency of power used to drive a gaseous discharge lamp, the electronic ballast disclosed by C. Stevens is advantageous in that it permits the lamp to operate more efficiently. It is also advantageous in that the increased frequency permits much smaller, lighter and more efficient components to be employed for the current limiting resonant network.

In an embodiment illustrated in FIG. 4B of the C. Stevens disclosure, the inverter is shown to include an oscillator and drivers driving a pair of transistors. The transistors operate as switches series connected across the output of a DC power supply in what may be referred to as a totem-pole configuration. The resonant network is shown to include a pair of inductors and a capacitor connected in a T-type configuration. More specifically, the two inductors are connected in series from the juncture of the switching transistors to one end of the lamp, the distal end of which is connected to a common potential. The capacitor is connected from the juncture of the inductors to the common potential. The common potential is developed at the juncture of a pair of capacitors series connected in a voltage-divider configuration across the output of the DC power supply. A phase detector is also included for synchronizing the frequency of the oscillator with the resonant frequency of the T-type network. Further, a current-sensing resistor is included, evidently for developing a signal for controlling the power supply.

By synchronizing the frequency of the oscillator with the resonant frequency of the network, the transistors switch at current-null points, switching losses are reduced, the transistors are protected and the switching transistors appear to be driving a resistive load. Further, synchronization insures that a maximum voltage step up will occur.

The electronic ballast disclosed by C. Stevens does not employ a simple power supply of the type which includes a bridge, or other form of rectifier, to develop pulses of direct current from the AC power line and a filter capacitor directly connected to the rectifier to develop a relatively constant voltage from the pulses of direct current. Such a simple power supply is disadvantageous in that all the current is drawn from the AC power line in synchronization with the peaks thereof. These current peaks cause power factor problems and problems sometimes referred to as third harmonic distortion problems. The occasional use of such simple power supplies causes little problem. However, where a large number of such supplies are connected to a single power line, such as to provide power for the lighting in a whole office building, problems with the pole transformer and power line wiring may result.

To avoid these problems, the electronic ballast disclosed by C. Stevens employs a relatively complex power supply having a switching regulator disposed between the bridge rectifier and the filter capacitor. The switching regulator interconnects the rectifier and the filter capacitor for brief periods at a high, 20 kHz, rate to form a train of current pulses at the 20 kHz rate. The regulator includes circuitry for varying the width of the current pulses in synchronization with the power-line frequency to develop wide pulses during the peaks of the power-line cycle and narrow pulses during the valleys thereof. As a result, the power supply disclosed by C. Stevens draws power from the AC line so as to appear as a load having a near unity power factor. Unfortunately, the power supply disclosed by C. Stevens is relatively complex and expensive.

Other disclosures which may be considered of interest include the U.S. Pat. Nos. 4,060,751, 4,127,798, 4,251,752, and 4,253,046 issued to T. Anderson, J. Anderson, J. Stolz and Gerhard et al, respectively.

SUMMARY OF THE PRESENT INVENTION

It is therefore an object of the present invention to provide an electronic ballast which is efficient, simple and inexpensive and which operates one or more gaseous-discharge lamps in a highly efficient and regulated manner.

Another object of the present invention is to provide a simple and inexpensive power supply which is suitable for use in an electronic ballast and which operates at a relatively high power factor.

Briefly, the preferred embodiment of the present invention includes a power supply and a power-factor-correcting circuit coupling the power supply to the AC power line, the correcting circuitry for restricting the amount of power the power supply can obtain from the line during peaks of the AC cycle to improve the power factor of the power supply. Also included is a pulse generator and a pair of transistors operating as switches, the transistors being connected across the output of the power supply in totem-pole fashion and being driven by the pulse generator so as to develop at their juncture a series of alternately positive-going and negative-going pulses each separated by a dead time. Finally, a network is included coupling the pulses developed by the transistors to one or more gaseous discharge-lamps, the network for limiting the lamp current and, in some embodiments, conditioning the level of the pulses. The pulse generator also monitors signals representing the current conducted by the lamp and the voltage developed thereacross, or other appropriate signals, and varies the frequency and/or width of the pulses as necessary to regulate the power consumed by the lamp.

The present invention is advantageous in that it operates gaseous discharge-lamps in a highly efficient and regulated manner yet it is relatively simple and inexpensive.

Another advantage of the present invention is that it has a relatively high power factor.

These and other objects and advantages of the present invention will no doubt become apparent to those of ordinary skill in the art after having read the following detailed description of the preferred embodiments illustrated in the several figures of the drawing.

IN THE DRAWING

DETAILED DESCRIPTION OF THE PREFERRED EMBODIMENTS

Figure 1:
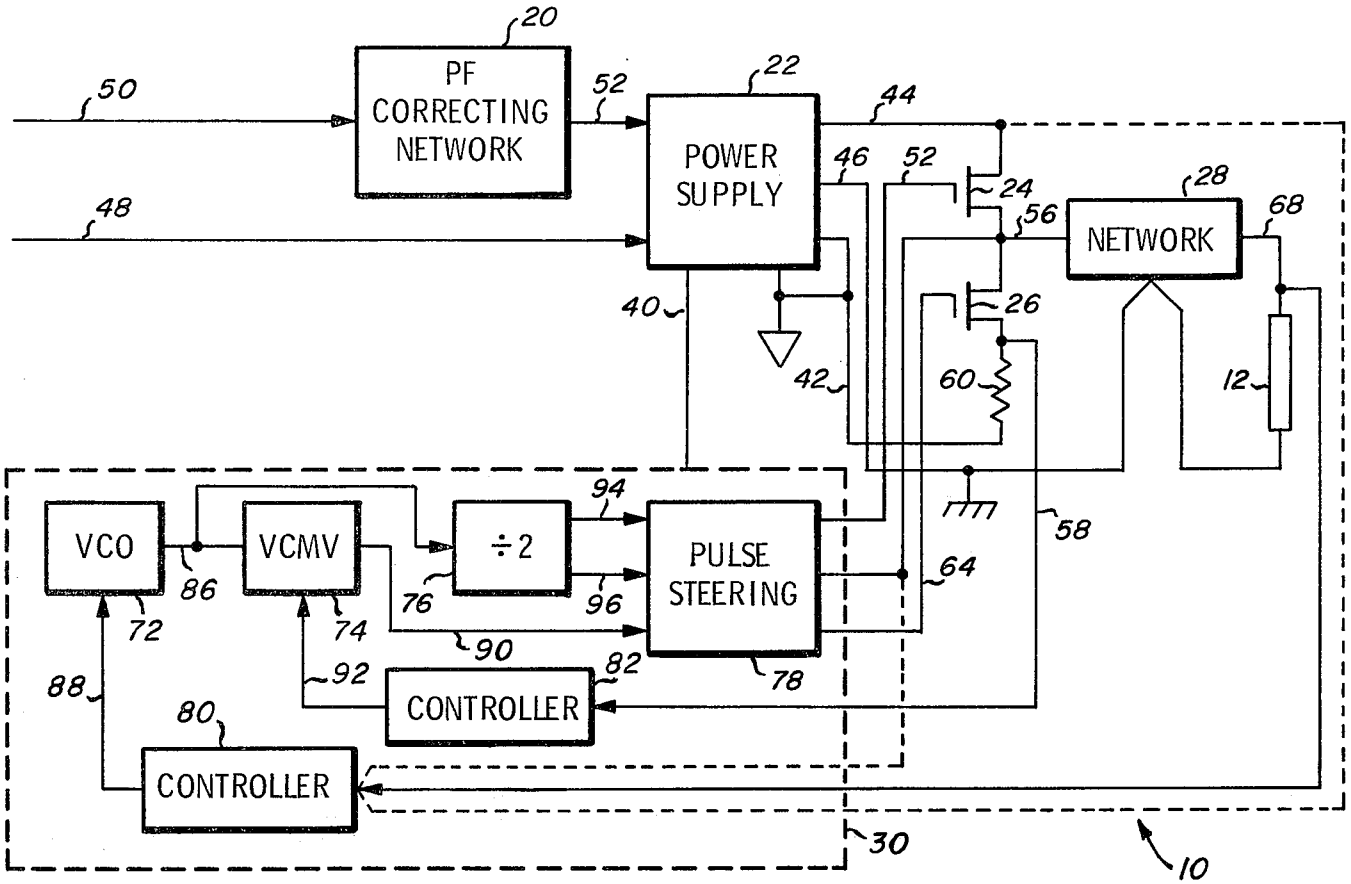
FIG. 1 is a combined block and schematic diagram illustrating the principal components of an embodiment of an electronic ballast in accordance with the present invention.

In accordance with the present invention, an electronic ballast suitable for use with one or more gaseous-discharge lamps is illustrated in FIG. 1 generally designated by the number 10, the lamps being represented by a single lamp 12. The principal components of ballast 10 are shown to include a power-factor-correcting network 20, a power supply 22, a pair of transistors 24 and 26, a energy-conditioning network 28 and a pulse generator 30.

Power supply 22 is of conventional design and suitable for providing lamp 12 lighting power at one DC potential and power for operating the various components of ballast 10 at another, lower, DC potential all from AC power obtained from the AC power line. Specifically, a line 40 is maintained at the lower potential with respect to the potential developed on a line 42; and, a line 44 is maintained at the higher potential, also with respect to the line 42 potential. Further, a line 46 is maintained at a potential midway between that of lines 42 and 44 to provide a common or return potential for lamp 12. For 110 volt mains, the line 46 potential is the same as the neutral, AC line potential. Where the line 46 potential is not conveniently available, this potential may be developed by means of a DC blocking capacitor connected between line 46 and line 42, line 44 or any line having a potential related thereto. Where network 28 includes a capacitor or other means which performs the DC blocking function, line 46 may be directly connected to line 42, line 44 or other potentially related line. For understanding the operation of ballast 10, it is convenient to consider the potential developed on line 42 as being the reference potential.

However, the operation of power supply 22 is restricted by power-factor-correcting network 20 which dictates when power may be obtained from the AC line. More specifically, supply 22 is coupled to the AC power line by network 20. For 110 volt mains, the neutral line, represented by a line 48, is directly connected to supply 22 and the hot line, represented by a line 50, is connected to one end of network 20 the distal end of which is connected to the power supply by a line 52. Network 20 includes a trap tuned to the third harmonic of the AC power line frequency. As a result, network 20 restricts the amount of power that supply 22 can obtain from the AC power line during peaks of the line cycle.

In the preferred embodiment, transistors 24 and 26 are metal-oxide-semiconductor, MOS, type power field-effect transistors, FETs, connected between lines 44 and 42 in what may be referred to as a totem-pole configuration so as to permit lines 44 and 42 to be selectively coupled to a line 56. In other words, transistor 24 has a drain which is connected to line 44 and a source which is connected to line 56. The drain of transistor 26 is connected to line 56; and, the source thereof, which is connected to a line 58, is coupled to line 42 by a current sensing resistor 60. Operation of transistors 24 and 26 is controlled by generator 30 which develops a transistor 24 gate-driving signal on a line 62 referenced to line 56 and a transistor 26 gate-driving signal on a line 64 referenced to line 42. Generator 30 sequentially drives transistors 24 and 26 in a non-overlapping fashion such that a potential is developed on line 56 in the form of alternate positive-going and negative-going pulses having dead time therebetween. This series of alternately positive-going and negative-going pulses is coupled to lamp 12 by a line 68 and network 28 which provides current limiting and, in some embodiments, voltage conditioning. Generator 30 monitors the operating parameters of lamp 12 by means of the signals developed on lines 58 and 68, including the current conducted therethrough, as evidenced by the voltage drop developed across resistor 60, and the voltage drop developed across the lamp and alters the width of the pulses or the frequency thereof so as to regulate the operation of lamp 12.

Generator 30 includes a voltage-controlled oscillator, VCO, 72, a voltage-controlled-monostable multivibrator, VCMV, 74, a divide-by-two flip-flop 76, a pulse-steering circuit 78 and a pair of controllers 80 and 82. VCO 72 is operative to develop a high-frequency signal on a line 86 which is responsive, in frequency, to the level of a control signal developed on line 88. VCMV 74 operates to develop a series of pulses on a line 90 each having a width that is responsive to a control signal developed on a line 92 and which occur at the frequency of the VCO signal developed on line 86. The frequency of the signal developed on line 86 is reduced by a factor of two by flip-flop 76 to develop a gating signal on a line 94 and a signal representing the complement thereof on a line 96. Responsive to the complementary gating signals developed on lines 94 and 96, circuit 78 alternately couples the pulses developed on line 90 to line 62 and line 64. Controllers 80 and 82 compare portions of the levels of the lamp-current-indicating signal developed on line 68 and the lamp-voltage-drop-indicating signal developed on line 58 with reference levels to develop the control signals on lines 88 and 92, respectively.

Figure 2:
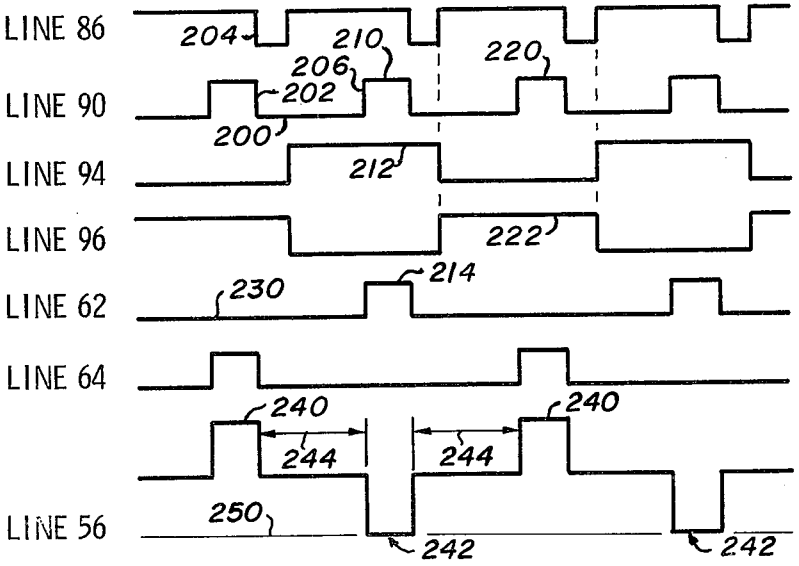
FIG. 2 is a timing diagram illustrating various operative states of the generator shown in FIG. 1.

FIG. 2 illustrates the operative states of generator 30. With reference to both FIGS. 1 and 2, the signal developed by VCO 72 on line 86 may be seen to be comprised of a series of negative-going pulses. Responsive thereto, VCMV 74 develops a series of pulses on line 90. Considering the pulses developed on line 90, for a moment, as being a series of negative going pulses, it may be noted that each negative going pulse has a leading, falling, edge which is triggered responsive to the leading, falling, edge of a corresponding pulse of those which are developed on line 86. The width of each pulse, including a pulse that is designated 200, is controlled by the signal developed on line 92. In other words, each high-to-low potential level transition of the signal developed on line 90, including a transition which is designated 202, occurs responsive to a corresponding high-to-low transition of the signal developed on line 86, in this case the transition which is designated 204, and is followed by a return to the high-logic-level potential, as indicated by a transition designated 206, a period of time thereafter which is controlled by the signal developed on line 92.

From FIG. 2, it may be seen that flip-flop 76, illustrated in FIG. 1, is edge triggered by each of the low-to-high potential level transitions of the signal developed on line 86 to develop the complementary gating signals on lines 62 and 64. Viewing pulses developed on line 90, now, as a series of positive going pulses, it may be seen that the pulse which occurs on line 90 during each of the periods when the potential level developed on line 94 is at a high-logic-level is coupled to line 62. Specifically, the pulse which is designated 210 and which occurs during the high-logic-level potential indicated at 212 is coupled to line 62 as a pulse which is designated 214. Similarly, the pulse which is designated 220 occurring during the time when the signal developed on line 96 is at the high-logic-level potential, as indicated at 222, is coupled to line 64 as a pulse which is designated 224. It should be noted that the pulses developed on line 62 are referenced to the potential level developed on line 56, designated by the number 230, rather than referenced to the reference-level potential developed on line 42. Finally, the signal developed on line 56 may be seen to be comprised of a series of alternately positive-going pulses, collectively designated 240, and negative-going pulses, collectively designated 242, having dead time therebetween, collectively designated 244. The reference-potential level developed on line 42 is illustrated by a line 250.

It should be noted that, for certain types of gaseous-discharge lamps, it may be advantageous to make the pulse width and/or frequency responsive to other currents or voltages. For example, the input of controller 82 may be connected to the secondary of a current transformer the primary of which is connected in series with lamp 12 and/or the input of controller 80 may be connected to line 44 or line 56, in the latter case to make the pulse width responsive to the power-supply voltage or the pulse amplitude, respectively. Further, lines 88 and 92 may be interchanged to make the frequency responsive to the current and the pulse width to the voltage.

Figure 3B:
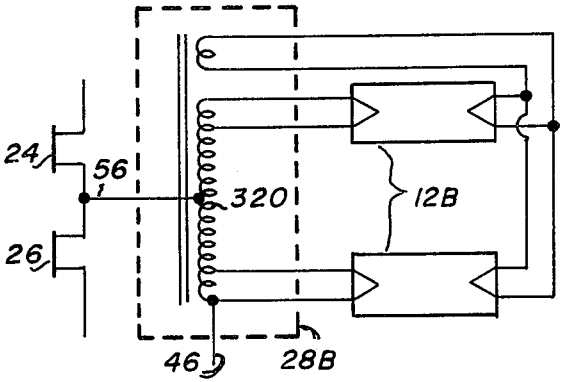
FIGS. 3A–3D are schematic diagrams illustrating various embodiments of the current limiting and voltage conditioning network shown in FIG. 1.
Figure 3D:
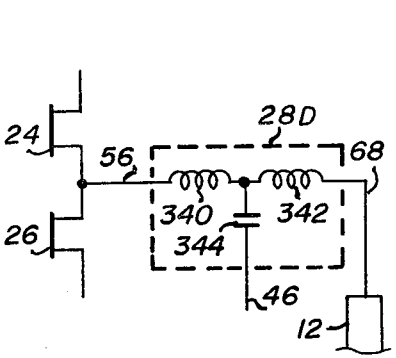
Figure 3C:
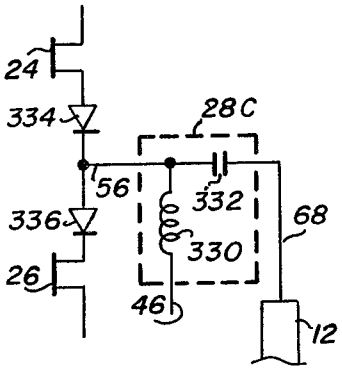
Figure 3A:
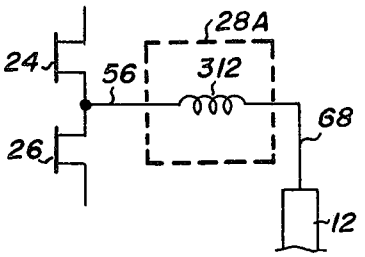

In FIGS. 3A–3D, representative embodiments of network 28 are illustrated. Where the amplitude of the pulses developed on line 56 is sufficient to ignite gaseous-discharge lamp 12, a simple current-limiting reactive element may be employed for network 28A as illustrated in FIG. 3A. Although a choke 310 is illustrated connected between lines 56 and 68, a capacitor having a suitable reactance may also be employed. Further, multiple reactive elements may be employed each connected with one or more lamps in series between lines 56 and 46 (shown in FIG. 1). The reactive elements may be comprised solely of chokes, solely capacitors or, preferable, a mix thereof.

Turning now to FIG. 3B, where the amplitude of the pulses developed on line 56 is insufficient to ignite lamp 12, the potential developed by power supply 22 (shown in FIG. 1) may be increased or network 28B may include a transformer such as the autotransformer designated 320. Although other transformer types may be employed, an autotransformer having filament windings is illustrated to show the use thereof for rapid-start-type fluorescent lamps represented by a pair of lamps designated 12B. Obviously, a separate, current-limiting, reactive element may be employed with transformer 320.

An important aspect of the present invention is the ability it affords to provide a simple and inexpensive means of lamp regulation. For example, constant lamp power may be maintained by monitoring lamp current and voltage and, responsive to changes therein, changing pulse width and pulse frequency. In otherwords, compensation for changes in height of the pulses may be had by changing the width of the pulses while holding the frequency thereof constant. Alternatively, compensation may be effected by changing the number of pulses generated in a given period, frequency, while maintaining the width of the pulses constant. Thus, constant lamp power may be maintained without the use of complex circuitry and without the use of an expensive, analogue, multiplying device sensing both voltage and current to provide a single feedback control signal.

With reference now to FIG. 3C, a practically unlimited lamp 12 starting potential may be obtained by the use in network 28C of an inductor 330 connected between lines 56 and 46 in what may be referred to as a double-ended-flyback configuration. Operationally, transistors 20 and 24 alternately charge inductor 330 with a pulse of energy which the inductor delivers to lamp 12. More specifically, with the conduction of each of transistors 20 and 24, an amount of energy is stored in inductor 330 that is proportional to the square of the peak current conducted, the peak current being proportional to the pulse width. The amount of power is equal to the frequency times the energy, the energy, as just noted, is proportional to the pulse width. Consequently, lamp 12 may be simply and economically regulated by varying the frequency and the pulse width. Dependent upon the potential developed by power supply 12 (shown in FIG. 1), the use of a capacitor 332, or other reactive element, connected between lines 56 and 68, may be appropriate for current limiting. Also, if transistors 24 and 26 are of the type which have intrinsic diodes, a pair of blocking diodes 334 and 336 connected in series with the respective transistor to line 56 may be required to isolate one transistor when the other transistor is turned off. Also, transistors 24 and 26 having a suitable stand-off voltage should be employed.

The configuration illustrated in FIG. 3C may be operated with a single transistor, such as transistor 24. However, the current requirements of transistor 24 are increased as is the required size of inductor 33D. Further, waveform control problems are presented.

In FIG. 3D, network 28D is shown to include an RF-type network for impedance matching and voltage multiplication. Although a pi, or other suitable RF-type network may be employed, a T-type RF network is illustrated which includes a pair of inductors 340 and 342 connected in series between lines 56 and 68 and a capacitor 344 connected between the juncture of the diodes and line 46. It has been found that with suitable component selection, proper operation of electronic ballast 10 (shown in FIG. 10) sufficiently close, within say five percent of the center frequency of network 28D, may be achieved without resort to frequency tracking. Obviously, use of the embodiment of the present invention illustrated in FIG. 1 with network 28D is appropriate where only one means of control, pulse width, need be employed to properly regulate lamp 12.

Figure 4:
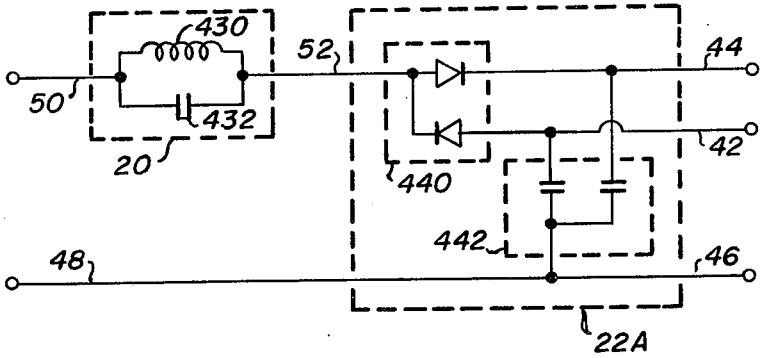
FIG. 4 is a schematic diagram further illustrating the power-factor-controlling network with the principal components of the power supply both shown in FIG. 1.

Turning now to FIG. 4, power-factor-correcting network 20 is illustrated in conjunction with the principal components, designated 28A, of power supply 28 (shown in FIG. 1), the components also being representative of the principal components of most, simple, power supplies. As previously indicated, network 20 is connected in series with power supply 22A across the AC power line, the network being connected between hot line 50 and line 52 and power supply 22A being connected between line 52 and neutral line 48, for 110 volt power mains. Comprising network 20 is a choke 430 and a capacitor 432 the combination connected in parallel in what may be referred to as a trap configuration, the choke and capacitor having suitable reactances whereby the trap is resonant at the third harmonic of the power line frequency. Power supply 22A includes means for reactifying 440 current from the AC power line and means for filtering 442 the rectified current to develop a source of DC power. Of course, rectifying means 440 may include means for voltage conditioning, such as a transformer, to adjust the potential developed by power supply 22A as appropriate. Further, filtering means 442 may include a pair of chokes each disposed in series with a respective one of the lines 42 and 44 between rectifying means 440 and the remainder of filtering means 442 or a single choke disposed in series with line 52 between network 20 and rectifying means 440. In this case, network 20 is most advantageous were the choke has an inductance which is less than the critical inductance for an inductive input power supply. Although the preferred embodiment of power supply 22A is in the form of a conventional voltage doubler, any other suitable configuration may be employed.

As is no doubt obvious, absent network 20, power supply 22A draws current from the AC power line in synchronization with the peaks thereof, causing power factor problems and third harmonic distortion problems. With network 20 present, such problems are reduced or avoided. Network 20 automatically synchronizes with the current demands of power supply 22A to present a relatively high impedance in synchronization with the power line peaks to limit the current the power supply can draw coincidently therewith. Thus, by suitably selecting the values of choke 430 and capacitor 432 the Q of the trap may be optimized for power supply 22A to minimize or eliminate power factor problems. In the preferred embodiment a choke having as inductance of approximately 78 millihenrys and a capacitor having a capacitance of approximately 10 microfarads are employed.

Figure 5:
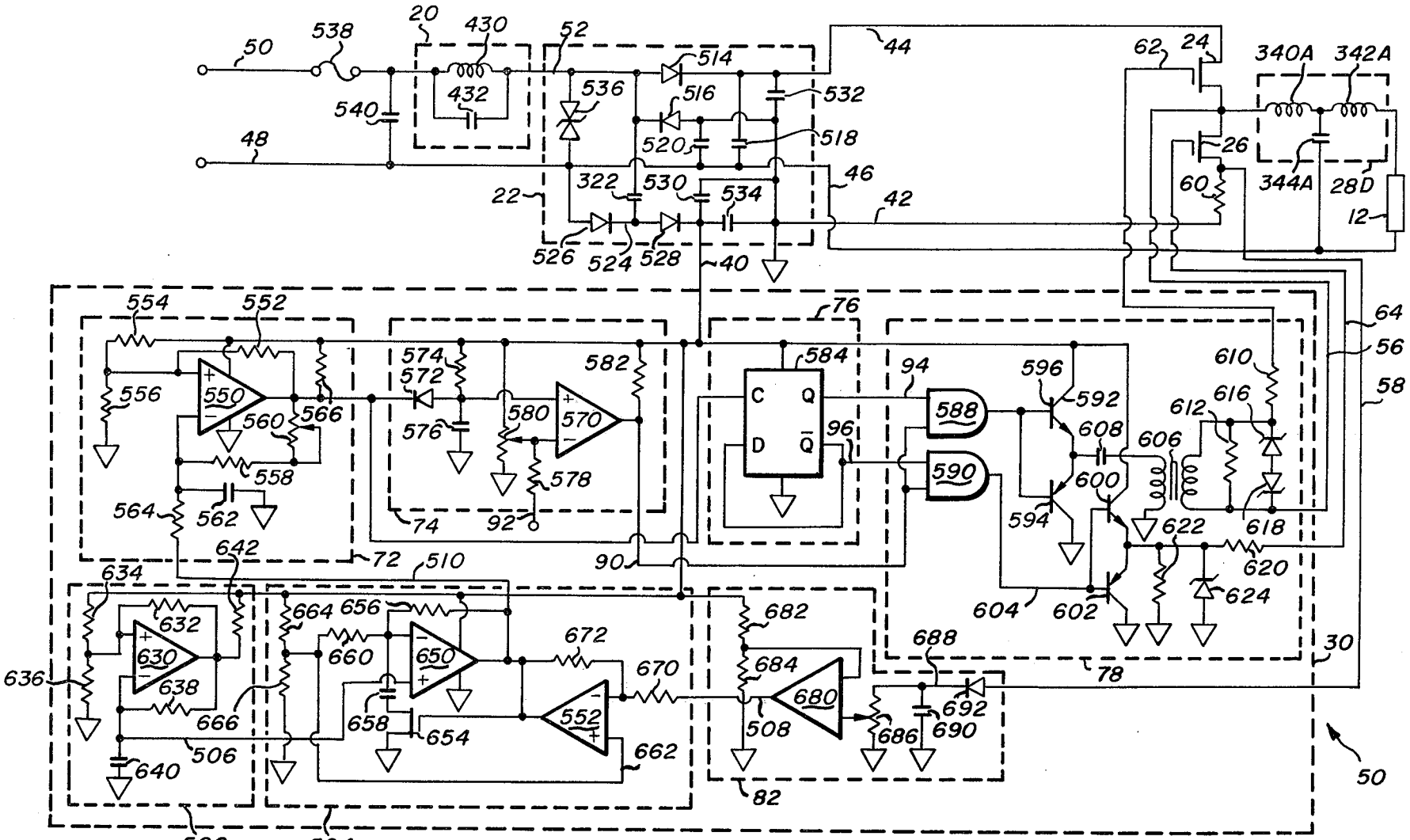
FIG. 5 is a schmatic diagram illustrating another embodiment of the electronic ballast in accordance with the present invention.

In FIG. 5, another embodiment of an electronic ballast in accordance with the present invention is shown generally designated by the number 500. Since many of the components of this embodiment are similar to corresponding components of the embodiment illustrated in FIG. 1, for clarity, similar components are similarly labeled. Generally, the two embodiments differ in that the embodiment illustrated in FIG. 5 also includes a 20 kHz triangular-wave-generating oscillator 52 and a pulse-width modulator 504, the combination for controlling the frequency of VCO 72, which, in this embodiment, is adjusted to operate at a frequency of approximately 80 kHz. In otherwords, from the triangular-wave signal which is developed by oscillator 502 on a line 506 and the control signal which, in this embodiment, is developed by controller 82 on a line 508 modulator 504 develops a signal on a line 510 for so controlling the frequency of VCO 72, that the VCO develops on line 86 and 80 kHz carrier signal pulse-width modulated at a 20 kHz rate to a depth which is controlled by controller 82.

In this embodiment, network 28 employs a lowpass, RF-type network of the type discussed in conjunction with FIG. 3D. In this embodiment, however, network 28 is designed to operate at the 80 kHz carrier frequency to remove the carrier frequency components while passing the modulation frequency components. As a result, the size of the network 28 components is reduced and their efficiency is improved. Lamp 12, on the other hand, is driven by a 20 kHz triangular-wave signal amplitude modulated responsive to the average current flowing through resistor 60. The triangular-wave shape is advantageous in that its harmonic content is low such that it is a good approximation of a sine wave.

Although controller 80 (shown in FIG. 1) may be employed to control VCMV 74, preferably, the width of the pulses developed by VCMV 74 is fixed so that the alternate positive-going and negative-going pulses developed on line 56 best approximate a sine wave, in otherwords, to minimize the third harmonic level.

More specifically, power supply 22 is shown to include a pair of rectifying diodes 514 and 516 and a pair of filter capacitors 518 and 520 the combination being connected in a conventional voltage doubler configuration, for 110 volt mains. Diode 514, connected between lines 52 and 44, and capacitor 518, connected between lines 44 and 46, develop a positive potential on line 44 with respect to the potential of line 46. A negative potential is developed on line 42 with respect to the potential on line 46 by diode 516, connected between lines 52 and 42, and capacitor 520, connected between lines 42 and 46. For 220 volt mains, diodes 514 and 516 are replaced by a bridge rectifier, the combination of capacitors 518 and 520 being employed, in the preferred embodiment, as a means for developing the line 46 potential. Obviously, a suitable transformer may also be included, disposed between the power lines and the diodes, to provide voltage conditioning.

A current-limiting capacitor 522 connected between line 52 and a line 524, a zener diode 526 connected between lines 524 and 48, a blocking diode 528 connected between lines 524 and 40 and a filter capacitor 530 connected between lines 40 and 42 provide a source of DC power for generator 30. Capacitor 522 provides a lossless impedance across which most of the AC potential is dropped. Diode 526 provides both negative clamping and positive regulation; and, diode 528 provides isolation for capacitor 530 during clamping. High frequency bypassing is provided by a capacitor 532 connected between lines 44 and 42 and a capacitor 534 connected between lines 40 and 42, the capacitors both isolating electronic ballast 50 from noise on the AC power lines and the AC power lines from signals generated by electronic ballast 500. An MOV varistor 536 connected between lines 52 and 48 provides surge protection. Finally, power supply 22 includes a fuse 538 and a high-frequency-bypass capacitor 540. Although fuse 538 may be connected in series with line 52 and capacitor 540 between lines 52 and 48, preferably, fuse 50 is connected in series with line 50 and capacitor 540 between lines 50 and 48.

VCO 72 includes an open-collector comparator 550 having a non-inverting input coupled to line 86 by a hysteresis-establishing resistor 552 and to the juncture of two resistors 554 and 556 connected in series between lines 40 and 42 as a voltage divider to, with resistor 552, set a pair of reference level potentials. The inverting input of comparator 550 is coupled to line 86 by the series combination of a fixed 558 and a variable 560 time-constant resistor, to line 42 by a time-constant capacitor 562 and to line 510 by a current-limiting resistor 564. The output of comparator 550, which is connected to line 86, is coupled to line 40 by an active pull-up resistor 566. Resistors 558 and 560 alternately charge and discharge capacitor 562 between the reference-level potentials set by resistors 552, 554 and 556. Preferably the resistance of resistors 554 and 556 is dissimilar whereby VCO 72 generates a series of narrow pulses rather than a square wave. Resistor 564 provides a means by which a control voltage on line 510 may alter the charging/discharging rate to control the VCO frequency. Finally, resistor 560 provides a means of setting the VCO center frequency between approximately 15 kHz and 100 kHz.

VCMV 74 includes an open-collector comparator 570 having a non-inverting input coupled to line 86 by a blocking diode 572, to line 40 by a time-constant resistor 574 and to line 42 by a time-constant capacitor 576. Further, comparator 570 has an inverting input coupled to line 92 by a current-limiting resistor 578 and connected to the wiper of a reference-level-potential-setting potentiometer 580 the respective distal ends of which are connected to lines 40 and 42. Finally, the output of comparator 570 is connected to line 90 and coupled to line 40 by an active pull-up resistor 582. Although the configuration is more that of a delay circuit, VCMV 74 operates as a voltage-controlled monostable multivibrator. Diode 572 clamps capacitor 576 to a low potential until a high-logic-level potential is developed on line 86. Thereafter, resistor 574 charges capacitor 576 until the potential developed on line 86 by comparator 550 again goes low. Comparator 570 maintains a low-logic-level potential on line 90 until capacitor 576 is charged past the potential developed at the wiper of potentiometer 580, at which time the line is released and resistor 582 develops a high-logic-level potential thereon.

Flip-flop 76 includes a D-type flip-flop device 584 having a clocking input connected to line 86, a data input connected to line 96, a non-inverted output connected to line 94 and an inverted or complementary output connected to line 96.

Pulse-steering circuit 78 includes a pair of 2-input AND gates 588 and 590 each having an input connected to line 90 for receiving the pulses developed thereon and an input connected to the respective one of lines 94 and 96 for receiving the complementary signals developed by flip-flop 76 for use in steering the pulses. Each of the gates drives a complementary pair of transistors connected in totem-pole fashion between lines 40 and 42. Gate 588 drives a pair of transistors 592 and 594, being connected thereto by a line 596; and, gate 590 drives a pair of transistors 600 and 602 to which it is connected by a line 604. Transistors 592, 594, 600, and 602, while not necessary, increase the driving capacity of gates 588 and 590 to increase the switching speed and the current handling capability.

A 1:1 pulse transformer 606 is included to permit the transistor 592 and 594 driving level to be offset as necessary to drive transistor 24. The primary winding of transformer 606 is connected between line 42 and an AC coupling capacitor 608 the distal end of which is connected to the juncture of the emitters of transistors 592 and 594. The secondary winding of transformer 606 is connected between line 56 and a current-limiting resistor 610 the distal end of which is connected to the gate of transistor 24 by line 62. Connected across the secondary of transformer 606 is a resistor 612 and a pair of back-to-back zener diodes 614 and 616. Resistor 612 provides damping; and, diodes 614 and 616 provide clamping so as to prevent gate-source breakdown in transistor 24 and the saturation of transformer 606. Finally, resistor 610 not only provides a limit to the current which charges the internal gate capacitance of transistor 24 but protects diodes 614 and 616 from leakage-reactance spikes fedback across transistor 24 by the Miller capacitance.

Similarly, the gate of transistor 26 is coupled by a current limiting resistor 620 to the juncture of the emitters of transistors 600 and 602 which are also coupled to line 42 both by a pull-down resistor 622 and a zener diode 624.

As previously indicated, choke 340A and capacitor 344A of network 28D provide low-pass filtering to remove the 80 kHz carrier frequency and choke 342A provides current limiting for lamp 12 at the 20 kHz triangular-wave frequency.

Like VCO 72, oscillator 502 employs an open-collector comparator 630, a hysteresis-establishing resistor 632, a pair of voltage divider resistors 634 and 636, a time-constant resistor 638, a time-constant capacitor 640 and an active pull-up resistor 642. Unlike VCO 72, the resistance of resistors 634 and 636 is similar; and, the triangular-wave output of the oscillator is employed, line 506 being connected to the juncture of resistor 638 and capacitor 640.

Modulator 504 includes a pair of operational amplifiers 650 and 652 and a N-channel enhancement-mode FET 654. Amplifier 650 has an inverting input coupled by a gain-setting feedback resistor 656 to line 510 and by a DC blocking capacitor 658 to the drain of transistor 654. Further, the inverting input of amplifier 650 is coupled by a gain-setting resistor 660 to a line 662 which is connected to the juncture of a pair of reference-level-potential-setting resistors 664 and 666 connected in series in a voltage divider configuration between lines 40 and 42. Amplifier 650 also has a non-inverting input connected to line 506 and an output connected to line 510.

Amplifier 652 has an inverting input coupled to line 508 by a gain-setting resistor 670 and to the output of the amplifier by another gain-setting resistor 672. Amplifier 652 also has a non-inverting input connected to line 662 and an output connected to the gate of transistor 654 which has a source connected to line 42. Preferably, amplifiers 650 and 652 are included in a dual or quad-amplifier-type device.

Operationally, amplifier 650 buffers and amplifies the oscillator signal developed on line 506. The gain of amplifier 650 is established by the resistance of resistors 656 and 660 and the resistance of transistor 654. The later resistance is set by amplifier 652 in response to the control signal developed on line 508 by controller 82.

Controller 82, which is similar to controller 80 (shown in FIG. 1), includes a comparator 680 having an output connected to line 508 and an input connected to the juncture of a pair of resistors 682 and 684 forming a voltage divider connected between lines 40 and 42. Comparator 680 has another input connected to the wiper of a potentiometer 686 the distal ends of which are connected between a line 688 and line 42. A capacitor 690 is connected between lines 688 and 42; and, a diode 692 is connected between lines 688 and 58. Controller 80 (shown in FIG. 1) also has a voltage-divider resistor connected in series with the diode that is equivalent to diode 692. Preferably, comparators 550, 570, 630 and 680 are all included in a quad-comparator-type device.

Although it is contemplated that after having read the preceeding disclosure certain alterations and modifications of the present invention will no doubt become apparent to those skilled in the art, it is intended that the following claims be interpreted to cover all such alterations and modifications as fall within the true spirit and scope of the invention.

I claim:

1. An electronic ballast for energizing a gaseous-discharge lamp and for regulating the power consumed thereby, the ballast comprising in combination:

means for developing a supply of DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

a current-limiting network for energizing the lamp from the potential developed between said transistor juncture and said power-supply-means common; and means for generating pulses for driving each of said transistors in turn whereby a potential is developed at said transistor juncture which alternates as positive-going and negative-going pulses each separated by a dead time, said pulse generating means for monitoring the power consumption level of said lamp and responsive thereto operative to vary the frequency of said transistor driving pulses whereby said lamp consumption is regulated, said pulse generating means including control means for developing a signal indicative of said consumption level, oscillator means for developing a signal having a frequency responsive to said control-means signal, monostable-multivibrator means triggered by said oscillator-means signal, said monostable-multivibrator means for developing a series of pulses each of predetermined width at said oscillator-means frequency, dividing means clocked by said oscillator-means signal and operative to develop a bistate signal at half said oscillator-means frequency, and gating means responsive to each pulse of said monostable-multivibrator-means series of pulses and operative to develop a corresponding one of said transistor driving pulses for driving a one of said transistors selected responsive to said dividing-means signal.

2. An electronic ballast as recited in claim 1 wherein said current-limiting network includes a current-limiting reactive element coupling said lamp between said transistor juncture and said power-supply-means common.

3. An electronic ballast as recited in claim 2 wherein said current-limiting network further includes a flyback inductor connected between said transistor juncture and said power-supply-means common.

4. An electronic ballast as recited in claim 2 wherein said reactive element is a capacitor and wherein said power-supply-means common is connected to one of said power-supply-means pair of outputs.

5. An electronic ballast as recited in claim 1 wherein said current-limiting network includes a transformer coupling said lamp between said transistor juncture and said power-supply-means common.

6. An electronic ballast as recited in claim 1 wherein said current-limiting network includes an RF-type network for coupling said lamp between said transistor juncture and said power-supply-means common.

7. An electronic ballast as recited in claim 1 wherein said control means develops said control-means signal responsive to the level of current flowing through one of said transistors.

8. An electronic ballast as recited in claim 1 wherein said control means develops said control-means signal responsive to the peak level of said potential developed at said transistor junction.

9. An electronic ballast as recited in claim 1 wherein said control means develops said control-means signal responsive to the potential level developed at one of said pair of power-supply-means outputs.

10. An electronic ballast for energizing a gaseous-discharge lamp and for regulating the power consumed thereby, said ballast comprising in combination:

means for developing a supply a DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

a current-limiting network for energizing the lamp from the potential developed between said transistor juncture and said power-supply-means common;

means for generating pulses for driving each of said transistors in turn whereby a potential is developed at said transistor juncture which alternates as positive-going and negative-going pulses each separated by a dead time, said pulse generating means for monitoring the power consumption level of said lamp and responsive thereto operative to vary the frequency of said transistor driving pulses whereby said lamp consumption is regulated; and a network for connection in series with said power-supply means across an AC power line, said network for increasing the power factor said power supply means presents to the line, said network including a capacitor having a predetermined capacitance and a choke connected in parallel with said capacitor, said choke having a predetermined inductance whereby said capacitor and said inductor resonate at a frequency between the second and the fourth harmonic frequencies of the power line frequency.

11. An electronic ballast for energizing a gaseous-discharge lamp and for regulating the power consumed thereby, said ballast comprising in combination:

means for developing a supply of DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

means for generating pulses for driving each of said transistors in turn whereby a potential is developed at said transistor juncture which alternates as positive-going and negative-going pulses each separated by a dead time, said pulse generating means for monitoring the power consumption level of said lamp and responsive thereto operative to vary the frequency of said transistor driving pulses whereby said lamp consumption is regulated, said pulse generating means including control means for developing a signal indicative of said consumption level, fixed oscillator means for developing a signal having a predetermined frequency, voltage-controlled-oscillator means for developing a signal having a frequency which is greater than said predetermined frequency, means for modulating the frequency of said voltage-controlled-oscillator means responsive to said fixed-oscillator-means signal to a depth controlled by said control-means signal, monostable-multivibrator means triggered by said voltage-controlled-oscillator-means signal, said monostable-multivibrator means for developing a series of pulses each of predetermined width at the frequency of said voltage-controlled-oscillator-means signal, dividing means clocked by said voltage-controlled-oscillator-means signal and operative to develop a bistate signal at half the frequency thereof, gating means responsive to each pulse of said monostable-multivibrator-means series of pulses and operated to develop a corresponding one of said transistor driving pulses for driving a one of said transistors selected responsive to said dividing-means signal; and a current-limiting network for energizing the lamp from the potential developed between said transistor juncture and said power-supply-means common, said current-limiting network including low-pass-filter means for rejecting said voltage-controlled-oscillator-means-signal frequency and for passing said predetermined frequency, said low-pass-filter means for coupling said lamp between said transistor juncture and said power-supply-means common.

12. An electronic ballast for energizing a gaseous-discharge lamp and for regulating the power consumed thereby, said ballast comprising in combination:

means for developing a supply of DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

a current-limiting network for energizing the lamp from the potential developed between said transistor juncture and said power-supply-means common; and means for generating pulses for driving each of said transistors in turn whereby a potential is developed at said transistor juncture which alternates as positive-going and negative-going pulses each separated by a dead time, said pulse generating means for monitoring the power consumption level of said lamp and responsive thereto operative to vary the width of said transistor driving pulses whereby said lamp consumption is regulated, said pulse generating means including control means for developing a signal indicative of said consumption level, oscillator means for developing a signal having a predetermined frequency, monostable-multivibrator means triggered by said oscillator-means signal, said monostable-multivibrator means for developing a series of pulses each of width responsive to said control-means signal, said monostable-multivibrator-means series of pulses occurring at said predetermined frequency, dividing means clocked by said oscillator-means signal and operative to develop a bistate signal at half said predetermined frequency, gating means responsive to each pulse of said monostable-multivibrator-means series of pulses and operative to develop a corresponding one of said transistor driving pulses for driving a one of said transistors selected responsive to said dividing-means signal.

13. An electronic ballast as recited in claim 12 wherein said current-limiting network includes a current-limiting reactive element coupling said lamp between said transistor juncture and said power-supply-means common.

14. An electronic ballast as recited in claim 13 wherein said current-limiting network further includes a flyback inductor connected between said transistor juncture and said power-supply-means common.

15. An electronic ballast as recited in claim 12 wherein said current-limiting network includes a tansformer coupling said lamp between said transistor juncture and said power-supply-means common.

16. An electronic ballast as recited in claim 12 wherein said current-limiting network includes an RF-type network for coupling said lamp between said transistor juncture and said power-supply-means common.

17. An electronic ballast as recited in claim 12 wherein said control means develops said control-means signal responsive to the level of current flowing through one of said transistors.

18. An electronic ballast as recited in claim 12 wherein said control means develops said control-means signal responsive to the peak level of the potential developed at said transistor junction.

19. An electronic ballast as recited in claim 12 wherein said control means develops said control-means signal responsive to the level developed at one of said pair of power-supply-means outputs.

20. An electronic ballast for energizing a gaseous-discharge lamp and for regulating the power consumed thereby, said ballast comprising in combination:

means for developing a supply of DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

a current-limiting network for energizing the lamp from the potential developed between said transistor juncture and said power-supply-means common;

means for generating pulses for driving each of said transistors in turn whereby a potential is developed at said transistor juncture with alternates as positive-going and negative-going pulses each separated by a dead time, said pulse generating means for monitoring the power consumption level of said lamp and responsive thereto operative to vary the width of said transistor driving pulses whereby said lamp consumption is regulated, and a newtork for connection in series with said power-supply means across an AC power line, said network for increasing the power factor said power supply means presents to the line, said network including a capacitor having a predetermined capacitance and a choke connected in parallel with said capacitor, said choke having a predetermined inductance whereby said capacitor and said inductor resonate at a frequency between the second and the fourth harmonic frequencies of the power line frequency.

21. An electronic ballast for energizing a gaseous-discharge lamp and for regulating the power consumed thereby, said ballast comprising in combination;

means for developing a supply of DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

means for generating pulses for driving each of said transistors in turn whereby a potential is developed at said transistor juncture which alternates as positive-going and negative-going pulses each separated by a dead time, said pulse generating means for monitoring the power consumption level of said lamp aid responsive thereto operative to vary the width of said transistor driving pulses whereby said lamp consumption is regulated, said pulse generating means including control means for developing a signal indicative of said consumption level, oscillator means for developing signal having a frequency responsive to the level of current flowing through one of said transistors, monostable-multivibrator means triggered by said oscillator-means signal, said monostable-multivibrator means for developing a series of pulses each of width responsive to said control-means signal, said monostable-multivibrator-means series of pulses occurring at said oscillator-means frequency, dividing means clocked by said oscillator-means signal and operative to develop a bistate signal at half said oscillator-means frequency, and gating means responsive to each pulse of said monostable-multivibrator-means series of pulses and operated to develop a corresponding one of said transistor driving pulses for driving a one of said transistors selected responsive to said driving-means signal; and a current-limiting network for energizing the lamp from the potential developed between said transistor juncture and said power-supply-means common.

22. An electronic ballast as recited in claim 21 wherein said control means develops said control-means signal responsive to the peak level of the potential developed at said transistor junction.

23. An electronic ballast as recited in claim 21 wherein said control means develops said control-means signal responsive to the potential level developed at one of said pair of power-supply-means outputs.

24. An electronic ballast for energizing a gaseous-discharge lamp and for regulating the power consumed thereby, the ballast comprising in combination:

means for developing a supply of DC power between a pair of outputs and for developing a power-supply-means common;

a pair of transistors connected as switches in series between said pair of power-supply-means outputs, said transistors for selectively coupling to the juncture thereof the potential developed at each of said pair of outputs;

current-limiting network for energizing the lamp from the potential developed between said transistor juncture and said power-supply-means common; and means for generating pulses for driving each of said transistors in turn whereby a potential is developed at said transistor juncture which alternates as positive-going and negative-going pulses each separated by a dead time, said pulse generating means for monitoring the power consumption level of said lamp and responsive thereto operative to vary the frequency of said transistor driving pulses whereby said lamp consumption is regulated, said pulse generating means including control means for developing a signal indicative of said consumption level, means for developing a series of pulses having a frequency responsive to said control-means signal, dividing means clocked by said series of pulses developing means and operative to develop a bistate signal at half said series of pulses developing means frequency, gating means responsive to each pulse of said series of pulses developing means series of pulses and operative to develop a corresponding one of said transistor driving pulses for driving a one of said transistors selected responsive to said dividing-means signal.

25. An electronic ballast as recited in claim 24 wherein said current-limiting network includes a current-limiting reactive element coupling said lamp between said transistor juncture and said power-supply-means common.

26. An electronic ballast as recited in claim 25 wherein said current-limiting network further includes a flyback inductor connected between said transistor juncture and said power-supply-means common.

27. An electronic ballast as recited in claim 25 wherein said reactive element is a capacitor and wherein said power-supply-means common is connected to one of said power-supply-means pair of outputs.

28. An electronic ballast as recited in claim 24 wherein said current-limiting network includes a transformer coupling said lamp between said transistor juncture and said power-supply-means common.

29. An electronic ballast as recited in claim 24 wherein said current-limiting network includes an RF-type network for coupling said lamp between said transistor juncture and said power-supply-means common.

30. An electronic ballast as recited in claim 24 wherein said control means develops said control-means signal responsive to the level of current flowing through one of said transistors.

31. An electronic ballast as recited in claim 24 wherein said control means develops said control-means signal responsive to the peak level of said potential developed at said transistor junction.

32. An electronic ballast as recited in claim 24 wherein said control means develops said control-means signal responsive to the potential level developed at one of said pair of power-supply-means outputs.

* * * * *